United States Patent [19]

Acton

[11] 4,024,976

[45] May 24, 1977

[54] TAMPERPROOF MOLDED PACKAGE

[75] Inventor: Daniel D. Acton, Lancaster, Ohio

[73] Assignee: Anchor Hocking Corporation, Lancaster, Ohio

[22] Filed: Oct. 30, 1975

[21] Appl. No.: 627,142

[52] U.S. Cl. ..... 215/32; 215/224; 215/256; 215/316; 220/276; 220/306

[51] Int. Cl.[2] ..... B65D 1/02; B65D 17/00

[58] Field of Search ..... 220/276, 266, 306, 270; 215/224, 7, 9, 32, 251, 254, 256, 316, 320

[56] References Cited

UNITED STATES PATENTS

| | | | |
|---|---|---|---|
| 3,672,528 | 6/1972 | Faulstich | 215/320 |
| 3,716,162 | 2/1973 | Botkin | 220/266 X |
| 3,817,420 | 6/1974 | Heisler | 220/276 X |
| 3,841,512 | 10/1974 | Botkin | 215/7 |
| 3,858,748 | 1/1975 | Marco | 220/276 |
| 3,940,004 | 2/1976 | Faulstich | 215/320 |

*Primary Examiner*—George T. Hall
*Attorney, Agent, or Firm*—Holland, Armstrong, Wilkie & Previto

[57] ABSTRACT

An improved package is described of the type used for packaging food products and other products. A molded plastic container is sealed with a closure cap. In order to prevent unauthorized or undetected opening of the container, a tamperproofing means is provided in the form of a tamperproofing band molded integrally with the container. This band is positioned so that it encloses at least the bottom edge of the closure cap skin when the cap is applied to the container. This requires at least a portion of the band to be removed before the cap can be removed from the container.

26 Claims, 17 Drawing Figures

Fig. 6.
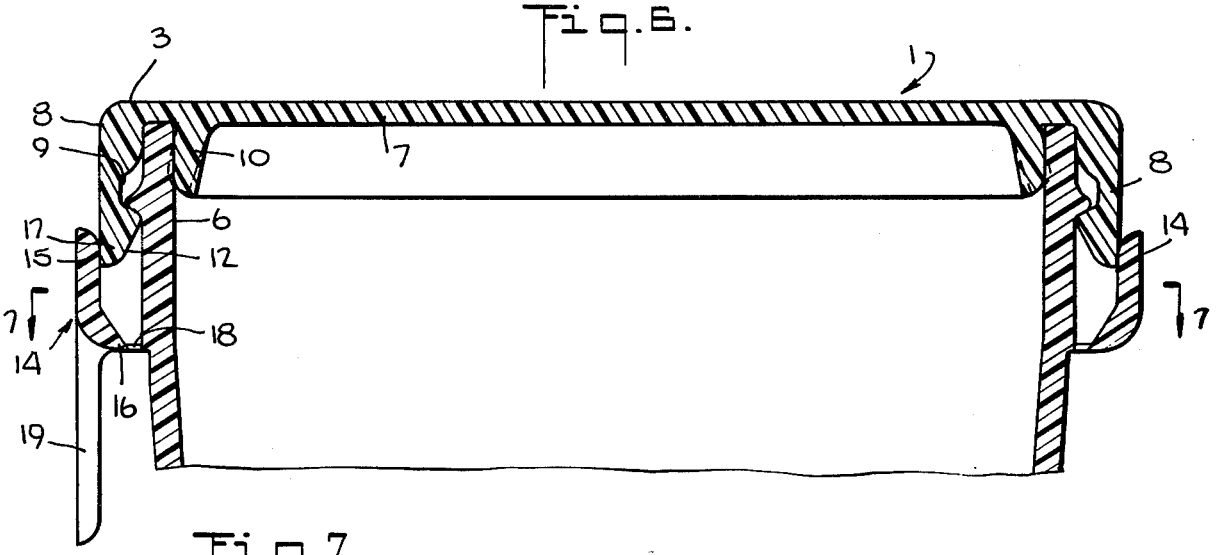
Fig. 7.
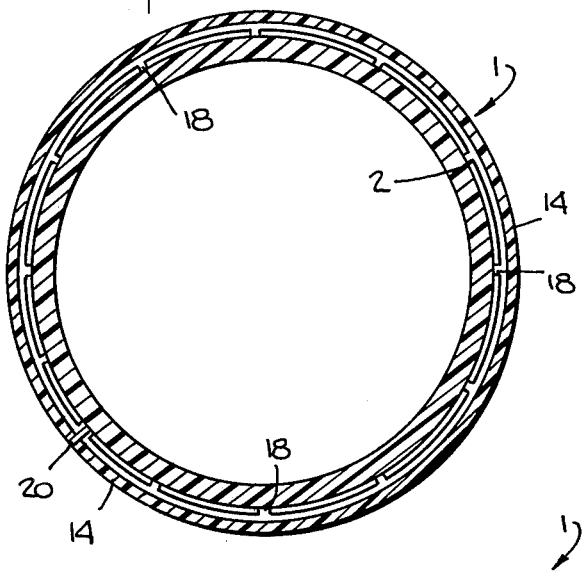
Fig. 8.
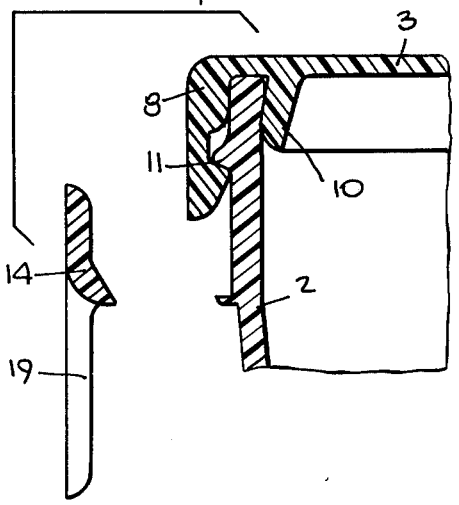
Fig 9.
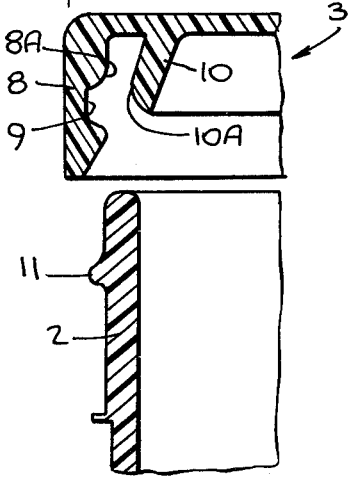
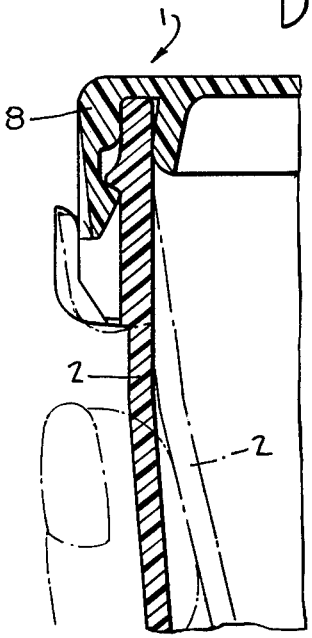
Fig 10.
Fig. 11.
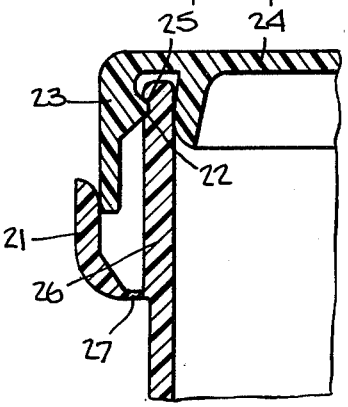

Fig.12.
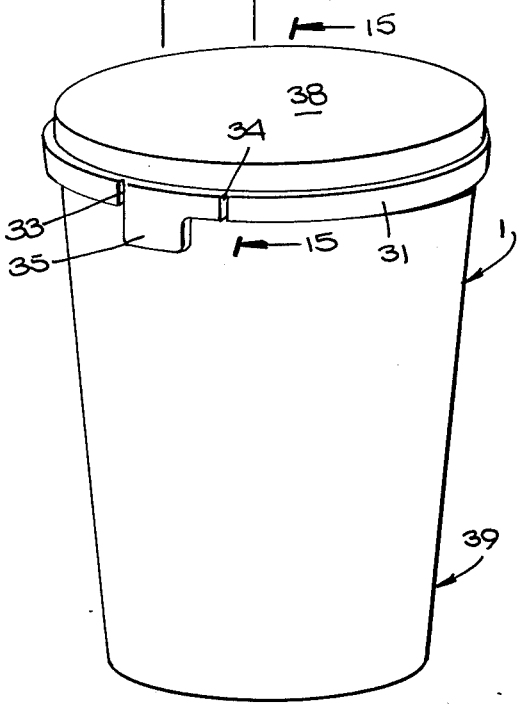
Fig.13.
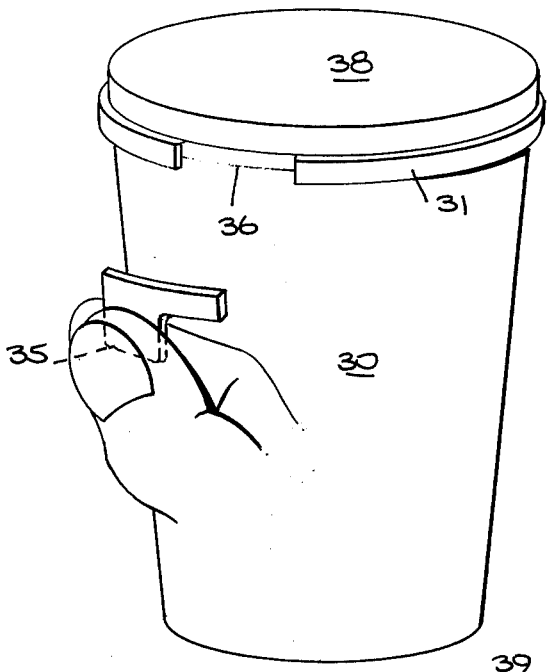
Fig.14.
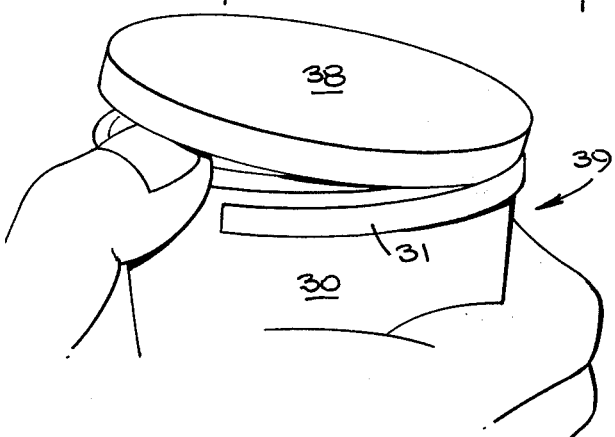
Fig.15.
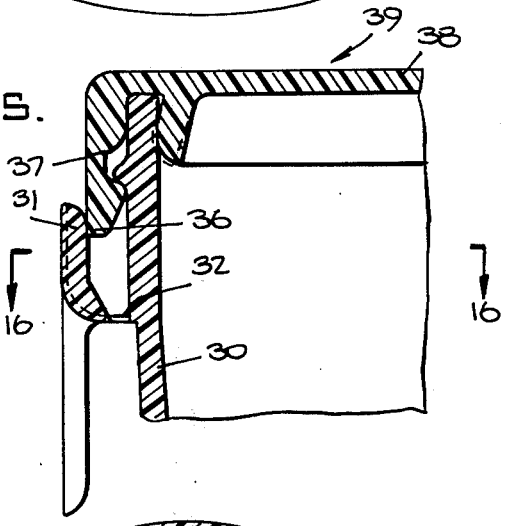
Fig.17.
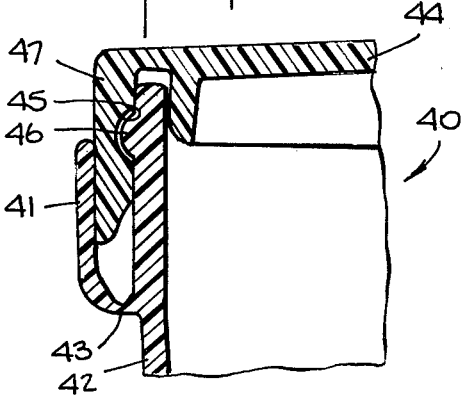
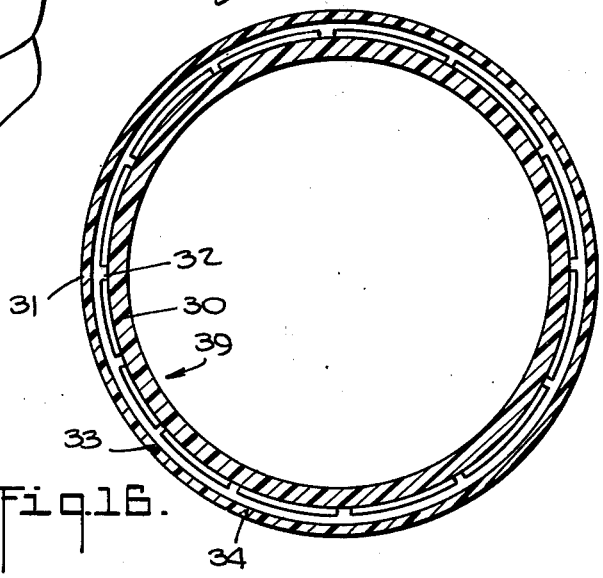
Fig.16.

TAMPERPROOF MOLDED PACKAGE

BACKGROUND OF THE INVENTION

The present invention relates to packages and more particularly to an improved tamperproof package having a molded plastic container sealed with a closure cap.

More particularly, the invention relates to an improved tamperproofing means on such a package where a tamperproofing band is molded as an integral portion of the plastic container.

An increasing number of articles including food products are being packaged in plastic containers or tubs which are molded from suitable plastics, such as polyethylene or polystyrene or other flexible plastics. These containers are sealed with closure caps which may be conveniently molded of plastic or which may be formed of other materials such as metal or paper. With many of the products thus packaged, it is desirable to protect the product against contamination or theft by an unauthorized opening of the package while it is being transported or displayed for sale. In order to prevent such unauthorized access, prior packages have utilized a number of tamperproofing devices such as removable bands or locks on the closure caps which must be removed or otherwise manipulated before the packages are opened. These prior tamperproofing means, however, have had certain serious disadvantages. In particular, the addition of tear strips or other lock means to closure caps has made them complicated and expensive and difficult to handle particularly during the package sealing operations.

The present invention provides a tamperproofing band as an integral portion of the container so that it may be formed during the regular molding of the container. The addition of such a tamperproofing band to the container does not interfere with the handling or filling of the container and permits the use of a relatively simple closure cap which is readily stored and transported and applied to the container using automatic sealing machines.

Accordingly, an object of the invention is to provide an improved tamperproof package.

Another object of the invention is to provide an improved molded plastic container with tamperproofing means.

Another object of the invention is to provide an improved plastic container having a tamperproofing means characterized by the use of an integrally molded tamperproofing band on the container.

Another object of the invention is to provide an improved tamperproof package which has a tamperproofing feature on a molded container and which is easily sealed and opened.

Another object of the invention is to provide a relatively inexpensive tamperproof package.

Other and further objects of the invention will be obvious upon an understanding of the illustrative embodiment about to be described or will be indicated in the appended claims, and various advantages not referred to herein will occur to one skilled in the art upon employment of the invention in practice.

BRIEF DESCRIPTION OF THE DRAWING

A preferred embodiment of the invention has been chosen for purposes of illustration and description and is shown in the accompanying drawings, forming a part of the specification, wherein:

FIG. 6 is a vertical sectional view of the package of FIG. 1 taken along line 6—6 on FIG. 1.

FIG. 7 is a horizontal sectional view of the package of FIG. 1 taken along line 7—7 on FIG. 6.

FIG.8 is a fragmentary vertical sectional view illustrating the removal of the tamperproof band.

FIG. 9 is a fragmentary vertical sectional view of the opened package.

FIG. 10 is a fragmentary vertical sectional view illustrating the continued tamperproofing action of the tamperproofing band during an inward pressing of the container adjacent its rim.

FIG. 11 is a fragmentary sectional view illustrating another embodiment of the package.

FIG. 12 is a perspective view of another embodiment of a tamperproof package in accordance with the present invention.

FIGS. 13 and 14 are perspective views illustrating successive steps during the opening of the package of FIG. 12.

FIG. 15 is a vertical sectional view of the package of FIG. 12 taken along line 15—15 on FIG. 12.

FIG. 16 is a horizontal sectional view of the package of FIG. 12 taken along line 16—16 on FIG. 15.

FIG. 17 is a fragmentary vertical sectional view illustrating another embodiment of the package.

DESCRIPTION OF THE PREFERRED EMBODIMENT

Figure 1:
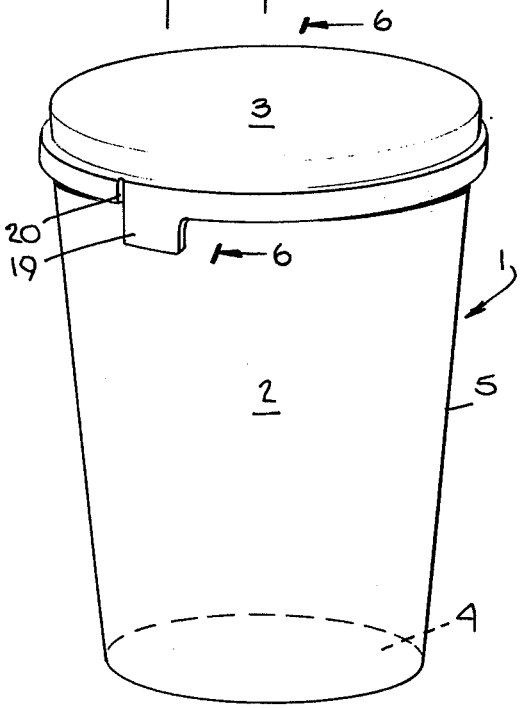
FIG. 1 is a perspective view of a preferred embodiment of the sealed package of the invention.
Figure 2:
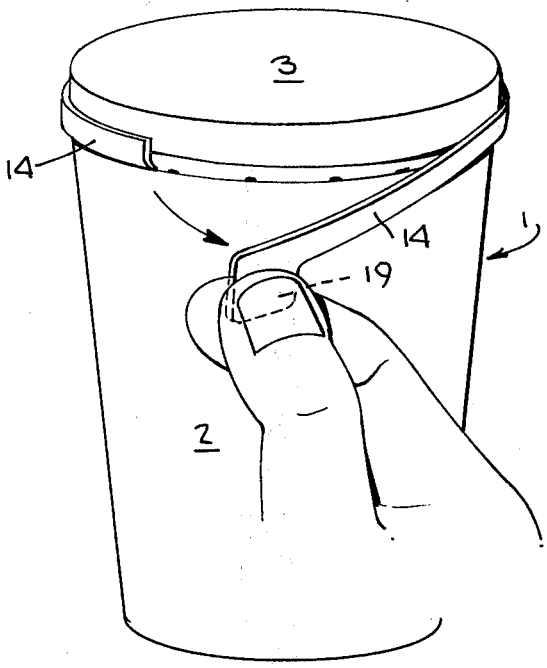
FIGS. 2 through 5 are perspective views of the package of FIG. 1 illustrating the successive steps in the removal of the tamperproofing band and the opening of the package.

There are a variety of products including food products which are conveniently packaged in cup-like or bowl-like containers molded of plastic. Such containers are sealed to form packages for the shipment of the products using closure caps. A convenient and effective means for removably attaching the closure caps to the containers uses cooperating ribs and grooves on the containers and caps. These closure caps are pressed onto the containers during the sealing operation and are thumbed or pried off when the containers are opened. The preferred embodiment illustrated in FIGS. 1–10, has a press-on closure, however, it is clear that other forms of closures including threaded or twist-on closures may be used in practicing the invention.

A preferred embodiment of a tamperproofing means, in accordance with the invention, is illustrated in FIGS. 1 through 10 and will now be described with reference to these figures. A package 1 comprises a hollow or tub-like container 2 sealed with a closure cap 3. The container 2 is formed of a molded plastic such as polyethylene or polystyrene or another suitable plastic by known forming procedures with the usual bottom 4, side walls 5, and closure cap receiving rim or open top portion 6. A preferred embodiment of the closure cap 3, which is also conveniently molded of plastic, is illustrated in detail in FIGS. 6 through 10. The closure cap 3 includes a cover 7 and a depending container engaging skirt 8 including a bead receiving groove 9 in the skirt 8. A circular sealing rib or plug 10 is positioned on the underside of the closure cap cover 7 which preferably has an outward flare. The flared rib 10 and the cap skirt 8 forms a pinched seal at points 8A and 10A (FIG. 9) making it unnecessary to have a seal at the rim top or finish of the container. Other sealing gaskets may be used with or in place of the rib 10. The groove 9 in the closure cap skirt 8 engages an outwardly projecting integral bead 11 on the container 2 when the cap 3 is pressed downwardly onto the container during the initial sealing or thereafter. The closure cap 3 is removed from the container 2 by being thumber or pried upwardly off of the container 2. The upper surface of the bead 11 has a steep slope to facilitate cap application while the undersides of the bead 11 and the cap groove 9 have more generally horizontal slopes for better cap retention. A flared lower inner surface 12 on the cap skirt 8 also facilitates the cap application.

A tamperproofing band 14 which prevents an undetected opening of the container 2 and which is formed integrally with the container 2 will now be described. As illustrated in FIGS. 1 and 6, the tamperproofing band 14 has a ring-like outer guard portion 15 whose lower edge 16 is detachably connected with the side walls of the container 2. The upper portion of the band 14 engages or nearly engages the outer lower edge 17 of the cap skirt 8 for concealing the edge 17 and for preventing access to it. It is impossible to engage the skirt 8 of the closure cap 3 with an adequate thumbing or prying force to lift the closure cap 3 clear of the container bead 11 as long as the tamperproofing ring 14 remains in position.

The detachable coupling may comprise a number of spaced bridges 18 or it may comprise other means such as a thin web-like member or a scored area.

FIG. 10 illustrates the action of the band 14 in maintaining its protective function of preventing cap removal from the container 2 even though the side wall 5 of the container 2 is pressed inwardly in an attempt to expose the lower edge 17 of the cap skirt 8. The overlapping relationship of the band 14 and the cap skirt 8 causes them to bend in also while retaining their same protective overlapping relationship as the skirt 8 moves inwardly with the band 14.

Figure 3:
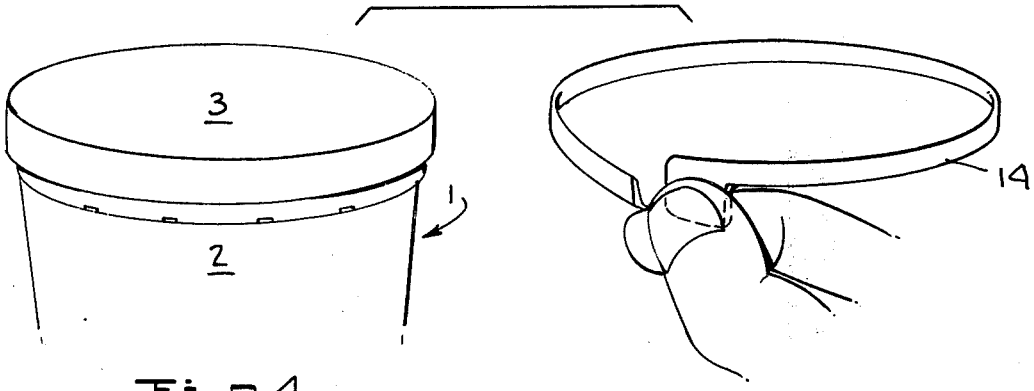
Figure 4:
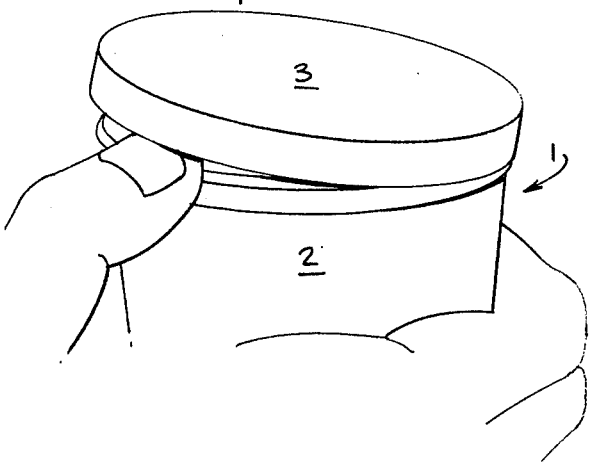
Figure 5:
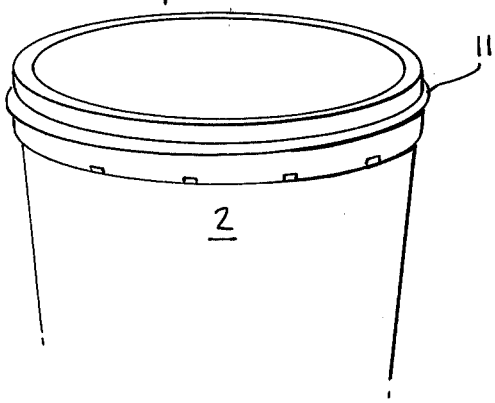

The package 1 is opened by first partially or completely removing the tamperproofing band 14. This is done by gripping the tab 19 on the band 14 in the manner illustrated in FIG. 2 and by tearing the band 14 from the container 2 as the score line 20 or other line of weakness breaks as illustrated in FIG. 3. This removal of the band 14 exposes the lower edge 17 of the cap skirt 8 permitting the cap 3 to be thumbed or pried off in the manner illustrated in FIGS. 4 and 9. The closure cap 3 is removed by forcing its skirt 8 clear of the closure retaining bead 11 on the container 2.

FIG. 11 illustrates another package having the same general tamperproofing arrangement with a band 21. An inwardly projecting bead 22 is provided on the skirt 23 of the closure cap 24 for engaging a cooperating groove 25 in the rim of the container 26. The detachable connection between the band 21 and the container 26 is a thin integral plastic web 27 or bridge 32.

FIGS. 12 through 16 illustrate another embodiment of the invention having a modified tamperproofing band where only an end portion of the band need be removed for cap removal. This embodiment has a container 30 formed of molded plastic. It also includes an integrally formed tamperproofing band 31 connected to the container 30 by a suitable zone of weakness which is shown as bridge members 32.

The tamperproofing band 31 has vertical score lines 33 and 34, or other lines of weakness, provided on opposite sides of a gripping tab 35. This permits an end portion of the band 31 to be broken off when the portion including the thumb gripping tab 35 is removed as illustrated in FIG. 13. This exposes a sufficient portion of the lower edge 36 of the skirt 37 of the closure cap 38 to permit the closure cap 38 to be thumbed or pried off as illustrated in FIG. 14.

FIG. 15 illustrates a cross-section of the closure cap 38 and the adjacent tamperproofing band 31 for the sealed package 39.

FIG. 16, which is a horizontal sectional view taken along the line 16—16 on FIG. 15, illustrates the spaced scored lines of weakness 33 and 34 which in this embodiment are spaced about 15° apart thereby exposing a lower edge portion 36 of the cap skirt 37 which is an inch or so in length to provide a suitable prying or thumbing zone for the opening action as illustrated in FIGS. 13 and 16.

FIG, 17 illustrates another embodiment of the invention. The package 40 has a tamperproofing band 41 which is shaped and formed as described above and which is attached to the container 42 by a line of weakness in the form of a score or groove 43. The closure cap 44 is detachably fastened to the container 42 by threads 45 and 46 on the closure cap 44 and the container 42. The band 41 covers a substantial portion of the cap skirt 47 so that the removal of the cap must be preceded by the removal of the band 41.

It will be seen that an improved package has been provided which is adapted for being formed from plastic, such as polyethylene or polystyrene or other flexible plastics, and which has an improved tamperproof feature. The positioning of the tamperproofing feature on the container or tub portion of the package permits the use of a relatively simple closure cap and thus facilitates the package manufacture, handling, and sealing. The improved package is useful in a large number of packing operations including food packing operations where the simplified handling of the package and closure facilitates a high speed and sanitary filling and sealing operation. The tamperproofing feature forms an integral part of the molded container so that it is easily provided on the container by conventional container forming methods.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. In a flexible plastic container having a relatively large open upper end for sealing with a press-on closure cap having a relatively shallow depending skirt, an improved tamperproofing means positioned adjacent to the open upper end and formed integrally with the container comprising:

a tamperproofing band spaced outwardly of the outer surface of the container adjacent to the open upper end of the container;

a lower portion only of said band being removably connected to the container by a frangible connecting means; and said tamperproofing band and said connecting means defining an upwardly facing channel with a fully open top for receiving at least the lower portion of a closure cap skirt whereby said band and said connecting means bar access to the lower edge of the skirt.

2. A container as claimed in claim 1 in which said band has a transverse line of weakness.

3. A container as claimed in claim 1 which further comprises a pair of spaced transverse lines of weakness on said band.

4. A container as claimed in claim 1 which further comprises a pair of spaced transverse lines of weakness on said band with a finger grip positioned on the shorter portion of said band intermediate to said lines of weakness.

5. A container as claimed in claim 1 in which said connecting means comprises a plurality of spaced bridge members.

6. A container as claimed in claim 1 in which said connecting means comprises a score line.

7. A container as claimed in claim 1 in which said connecting means comprises a web.

8. A container as claimed in claim 1 in which said container comprises a closure engaging bead adjacent to the said open top.

9. A container as claimed in claim 1 in which said container comprises a closure engaging groove adjacent to the open top.

10. A container as claimed in claim 1 in which said container comprises polyethylene.

11. A container as claimed in claim 1 in which said container comprises polystyrene.

12. A container as claimed in claim 1 in which said container comprises a molded flexible plastic.

13. A sealed package comprising:

a flexible plastic container having an open upper end sealed with a closure cap having a relatively shallow depending skirt;

a tamperproofing band spaced outwardly of the outer surface of the container adjacent to the open upper end of the container;

a lower portion only of the band being removably connected to the container by a frangible connecting means; and said tamperproofing band and said connecting means defining an upwardly facing channel with a fully open top receiving the lower portion of the closure cap skirt whereby said band and said connecting means bar access to the lower edge of the skirt.

14. A package as claimed in claim 13 in which said band has a transverse line of weakness.

15. A package as claimed in claim 13 which further comprises a pair of spaced transverse lines of weakness on said band.

16. A package as claimed in claim 13 which further comprises a pair of spaced transverse lines of weakness on said band with a finger grip positioned on the shorter portion of said band intermediate to said lines of weakness.

17. A package as claimed in claim 13 in which said connecting means comprises a plurality of spaced bridge members.

18. A package as claimed in claim 13 in which said connecting means comprises a score line.

19. A package as claimed in claim 13 in which said connecting means comprises a web.

20. A package as claimed in claim 13 in which said container comprises a closure engaging bead adjacent to the said open top.

21. A package as claimed in claim 1 in which said container comprises a closure engaging groove adjacent to the open top.

22. A package as claimed in claim 13 in which said container comprises polyethylene.

23. A package as claimed in claim 13 in which said container comprises polystyrene.

24. A package as claimed in claim 13 in which said container comprises a molded flexible plastic.

25. A package as claimed in claim 13 in which said closure cap further comprises a sealing rib depending from the underside of the closure cap cover and positioned inwardly of the cap skirt engaging an inner wall of said container.

26. A sealed package as claimed in claim 25 in which said sealing rib tapers outwardly forming a pinched seal with the container rim in combination with the closure cap skirt.

* * * * *